US007094039B2

(12) United States Patent
Hu et al.

(10) Patent No.: US 7,094,039 B2
(45) Date of Patent: Aug. 22, 2006

(54) HEAT-DISSIPATING FAN

(75) Inventors: Kenny Hu, Taipei Hsien (TW); Victor Peng, Taipei Hsien (TW)

(73) Assignee: Act-Rx Technology Corporation, (TW)

( * ) Notice: Subject to any disclaimer, the term of this patent is extended or adjusted under 35 U.S.C. 154(b) by 399 days.

(21) Appl. No.: 10/442,123

(22) Filed: May 21, 2003

(65) Prior Publication Data

US 2004/0234398 A1 Nov. 25, 2004

(51) Int. Cl.
*F04B 17/03* (2006.01)

(52) U.S. Cl. ..... 417/354; 417/423.7; 417/423.12

(58) Field of Classification Search ..... 417/354, 417/423.7, 423.12
See application file for complete search history.

(56) References Cited

U.S. PATENT DOCUMENTS 4,564,335 A * 1/1986 Harmsen et al. ..... 417/354
4,801,252 A * 1/1989 Wrobel ..... 417/354
4,806,081 A * 2/1989 Harmsen et al. ..... 417/354
6,246,140 B1 * 6/2001 Horng ..... 417/423.12
6,270,325 B1 * 8/2001 Hsieh ..... 417/423.12
6,398,526 B1 * 6/2002 Yang ..... 417/423.7
6,488,483 B1 * 12/2002 Hsieh ..... 417/354
6,699,020 B1 * 3/2004 Lin ..... 417/354
2004/0120833 A1 * 6/2004 Hsieh ..... 417/354

* cited by examiner

*Primary Examiner*—Michael Koczo, Jr.
(74) *Attorney, Agent, or Firm*—Browdy and Neimark, PLLC

(57) ABSTRACT

A heat-dissipating fan of the invention has an axle, a bearing, a rotor and a stator. The axle and the bearing are made of a ceramic material, and are located at a central location of the rotor and the stator. The bearing is a hollow cylinder integrally formed into a single body, and has a central hole and a recess at its bottom. The axle penetrates through the central hole of the bearing to contact the recess. A magnetic force center of the silicon steel sheet is at a level lower than that of the magnetic bar to generate radial and axial force components, allowing stable rotation of the rotor. The heat-dissipating fan of the invention provides advantages such as low friction, lower noise, low energy consumption, high performance and high stability.

6 Claims, 5 Drawing Sheets

HEAT-DISSIPATING FAN

BACKGROUND OF THE INVENTION

1. Field of the Invention

The invention relates to a heat-dissipating fan, and more particularly, to a heat-dissipating fan suitable for use in an electrical appliance such as a personal computer.

2. Description of the Related Art

As the performance of technical devices such as an electric appliance progresses, issues related to heat dissipation in highly integrated devices are more critical. FIG. 1 is a cross-sectional view of a motor 7 of a conventional heat-dissipating fan. The motor 70 includes an axle 70, a bearing 71, a rotor 72 and a stator 73. The axle 70 is made of stainless steel, located at a central location of the rotor 72. A magnetic bar 74 is mounted on a side of the rotor 72. The bearing 71 is located at a central location of the stator 73. The stator 73 is further provided with a silicon steel sheet 75. The axle 70 of the rotor 72 penetrates the bearing 71 of the stator 73. The axle 70 has an oil guide 76 at its upper end and a C-shaped fastener 77. After electrical power is supplied, lines of magnetic force are produced between the rotor 72 and the stator 73 to drive the motor 7 in rotation.

The magnetic lines induced by the magnetic bar 74 and the silicon steel 75 are centrally located on a same plane. Only the radial direction of the magnetic lines contributes to the rotation of the rotor 72, while the weight load is principally supported by the surface where the axle 70 and the bearing 72 come into contact with each other. Therefore, the rotor 72 easily slants toward the stator 73. When the motor 7 rotates, the rotor 72 deviates from its normal path and wears away the bearing 7 in a radial direction. Consequently, the bearing 7 becomes elliptic or irregular, which increases the friction coefficient, and causes erratic running of the motor, a louder mechanic noise and a shorter service life. Furthermore, the type of conventional heat-dissipating fan is not suitable for use in portable products that are usually used in different positions and orientations.

SUMMARY OF THE INVENTION

It is therefore an object of the invention to provide a heat-dissipating fan that can provide advantages such as a low friction, a lower operation noise, a low energy consumption, a high performance and a high stability due to the configuration of the bearing and the lines of magnetic force induced by the silicon steel sheet and the magnetic bar.

In order to achieve the above and other objectives, a heat-dissipating fan of the invention includes an axle, a bearing, a rotor and a stator. The axle and the bearing are made of a ceramic material, which provides anti-corrosion, anti-oxidation and anti-erosion properties. The axle is a cylinder having a pointed or rounded tip, and is located inside the rotor. The bearing is a hollow cylinder located inside the stator. The bearing is provided with a central hole through which the axle penetrates to contact the bearing. The bearing shares the weight load of the rotor from the axle and provides anti-dust and anti-oil leakage advantages. A magnetic force center of the silicon steel sheet is at a level lower than that of the magnetic bar to generate radial and axial force components, allowing stable rotation of the rotor.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
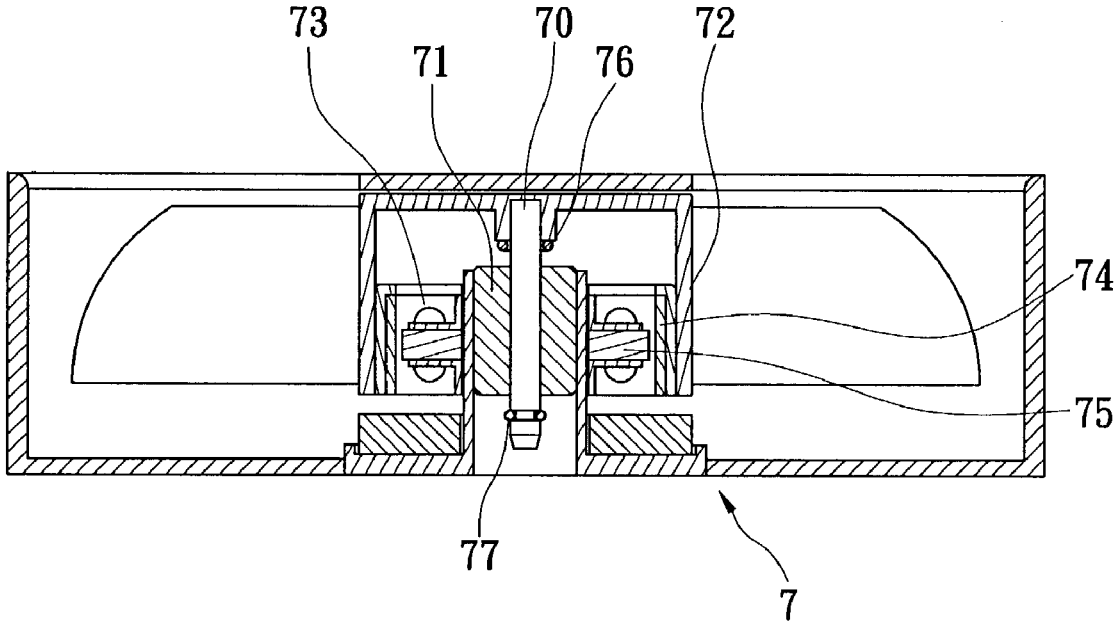
FIG. 1 PRIOR ART
FIG. 1 is a cross-sectional view of a conventional heat-dissipating fan.

Wherever possible in the following description, like reference numerals will refer to like elements and parts unless otherwise illustrated.

Figure 2:
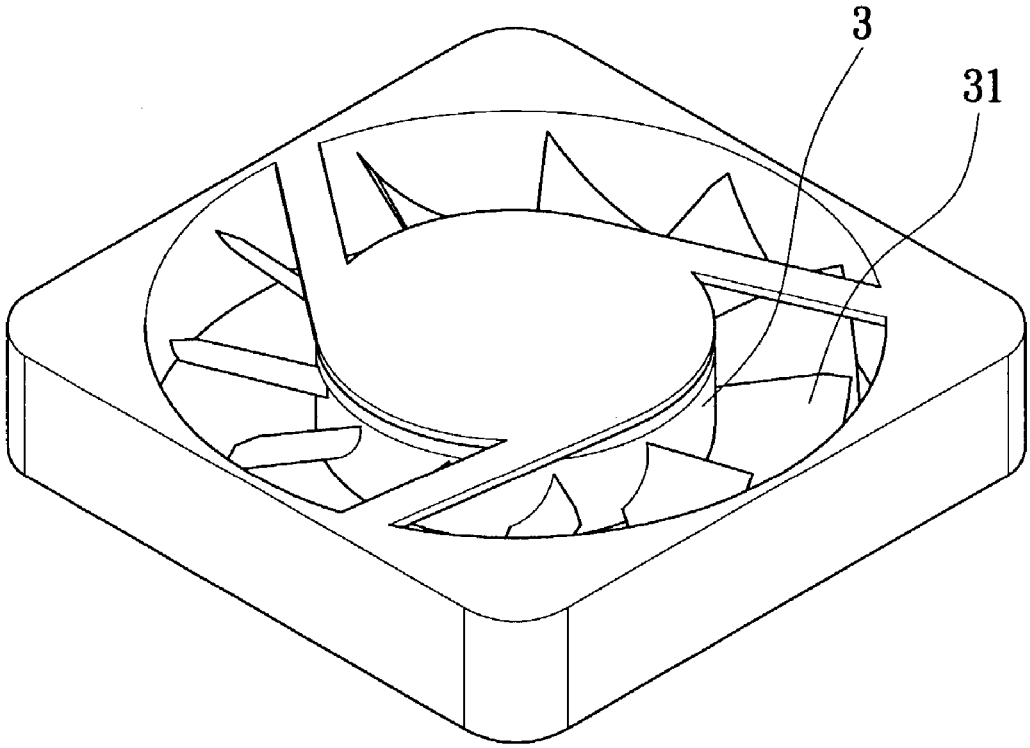
FIG. 2 is a perspective view of a heat-dissipating fan according to one embodiment of the invention.
Figure 3:
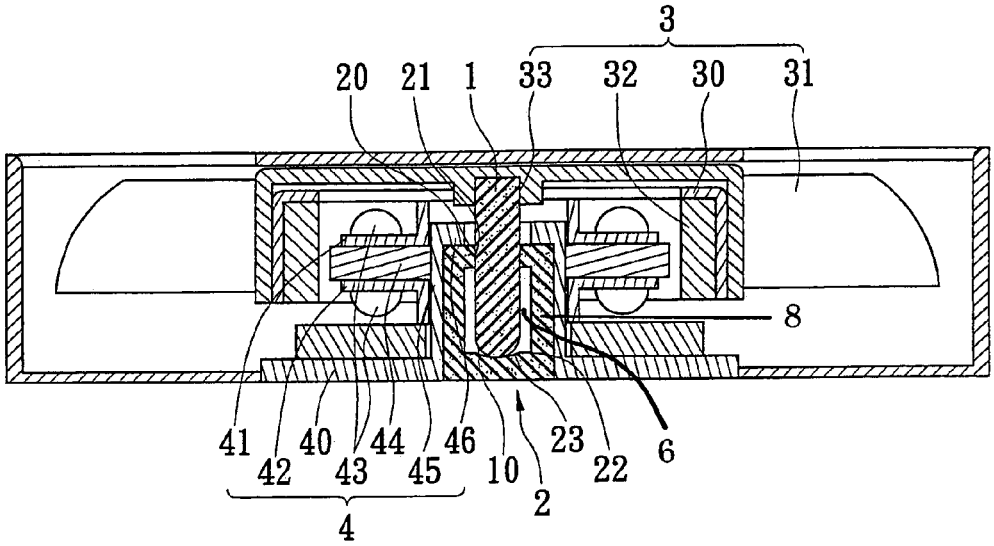
FIG. 3 is a cross-sectional view of a heat-dissipating fan according to one embodiment of the invention.

Referring to FIG. 2 and FIG. 3, the invention provides a heat-dissipating fan including an axle 1, a bearing 2, a rotor 3 and a stator 4.

The axle 1 is a cylinder made of, for example, ceramic material. The axle 1 has a pointed or rounded tip 10.

The bearing 2 is a hollow cylinder having a top side and a bottom side 22, for example, integrally formed of ceramic material or alloy. A central hole 21 is formed through the top side 20 of the bearing 2. A recess 23 is formed at central location of an interior of the bottom side 22 of the bearing 2, directly under the central hole 21.

The rotor 3 includes a motor casing 30, a plurality of blades 31 and a magnetic bar 32. The motor casing 30 is a casing having a down-facing opening and a blind hole 33 at a central location of an interior of the casing 30 for accommodating the axle 1. The blades 31 are mounted on an external surface of the motor casing 30, and the magnetic bar 32 is mounted inside the motor casing 30.

The stator 4 includes a base 40, an upper coil frame 41, a lower coil frame 42, a coil 43 and a silicon steel sheet 44. An annular wall 45 extends upward from a central portion of the base 40. The upper coil frame 41 and the lower coil frame 42 are mounted outside the annular wall 45. The annular wall 45 further has a flange 46 to securely position the bearing in the annular wall 45. The silicon steel sheet 44 is mounted between the upper and lower coil frames 41, 42. A magnetic force center of the silicon steel sheet 44 is at a level lower than that of the magnetic bar 32. The coil 43 is wrapped around the upper coil frame 41, the silicon steel sheet 44 and the lower coil frame 42.

One end of the axle 1 is mounted in the blind hole 33 of the rotor 3. The pointed or rounded tip 10 of the rotor 3 engages and extends through the central hole 21 creating a space 6 between axle 1 and cylinder wall 8 into to contact with the recess 23. The annular wall 45 of the stator 4 and the flange 46 serve to receive the axle 1. Thereby, the heat-dissipating fan of the invention is constructed.

Figure 4:
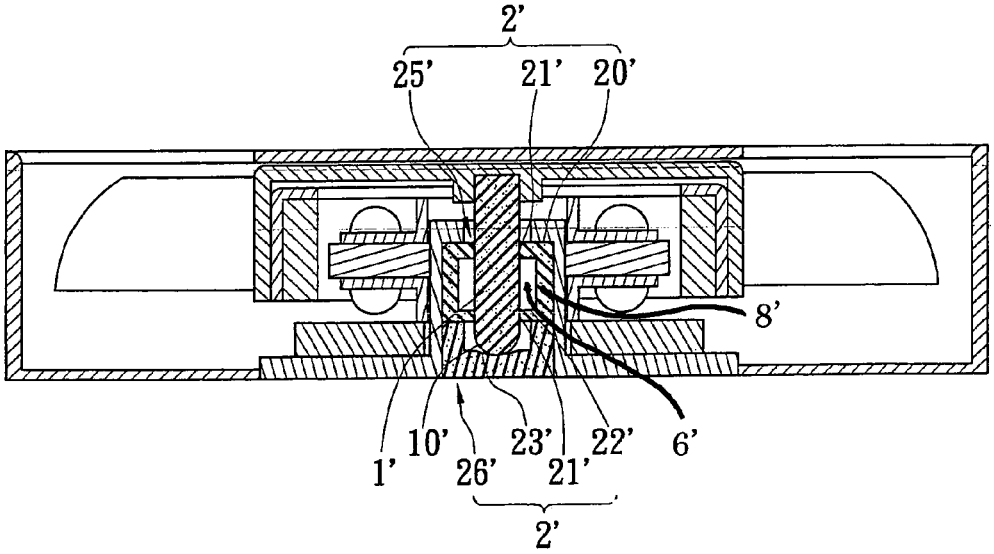
FIG. 4 is a cross-sectional view of a heat-dissipating fan according to a first embodiment of the invention.

FIG. 4 is a cross-sectional view of a heat-dissipating fan according to a first embodiment of the invention. The bearing 2' includes a body 25', which is a hollow cylinder. A disk-shaped base 26' having a recess 23' is disposed under the bearing 2'. A central hole 21' is formed through a top side 20' and a bottom side 22' of the body 25'. The axle 1' engages and extends through both central holes 2' creating a space 6' between axle 1' and cylindrical wall 8'. The base 26' is mounted beneath the bottom 22' in such a manner that the recess 23' aligns with the central hole 21' to allow a pointed or rounded tip 10' of an axle 1' to penetrate through the central hole 21' and thereby contacts the recess 23'. With the bearing 2' having the body 25' and the base 26', the formation of the central hole 21' and recess 23' is easily achieved.

Figure 5:
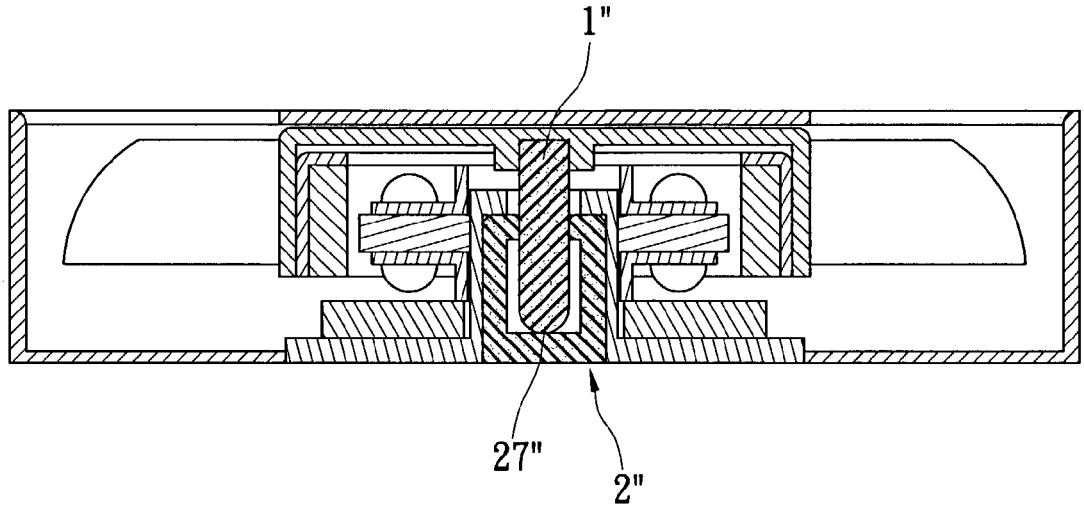
FIG. 5 is a cross-sectional view of a heat-dissipating fan according to a second embodiment of the invention.
Figure 6:
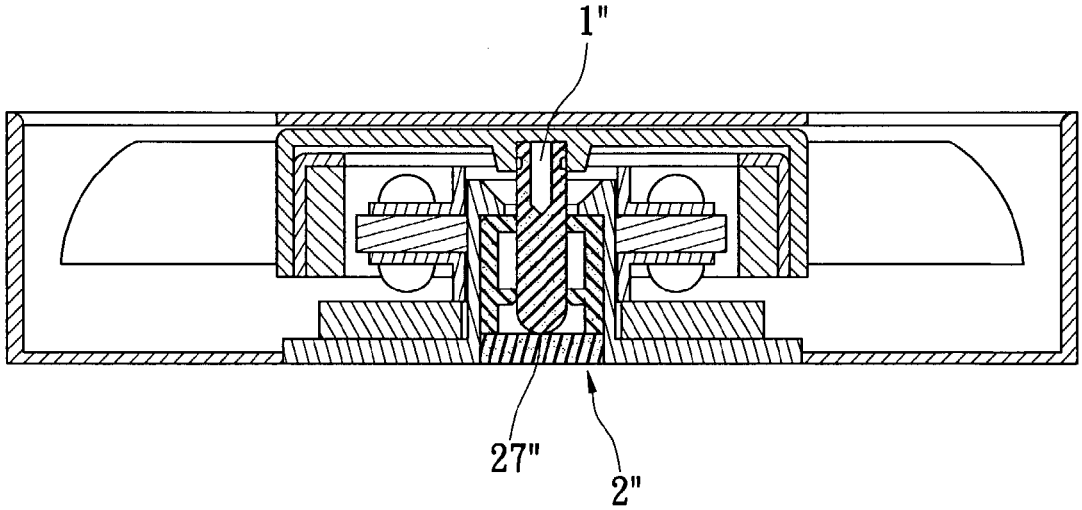
FIG. 6 is a cross-sectional view of a heat-dissipating fan according to a third embodiment of the invention.

FIG. 5 and FIG. 6 are respectively cross-sectional views of a heat-dissipating fan according to second and third embodiments of the invention. Reference numeral 27" designates a surface on which a bearing 2" and an axle 1" come into contact with each other. According to the embodiment of the invention, the surface 27" can be easily constructed.

Figure 7:
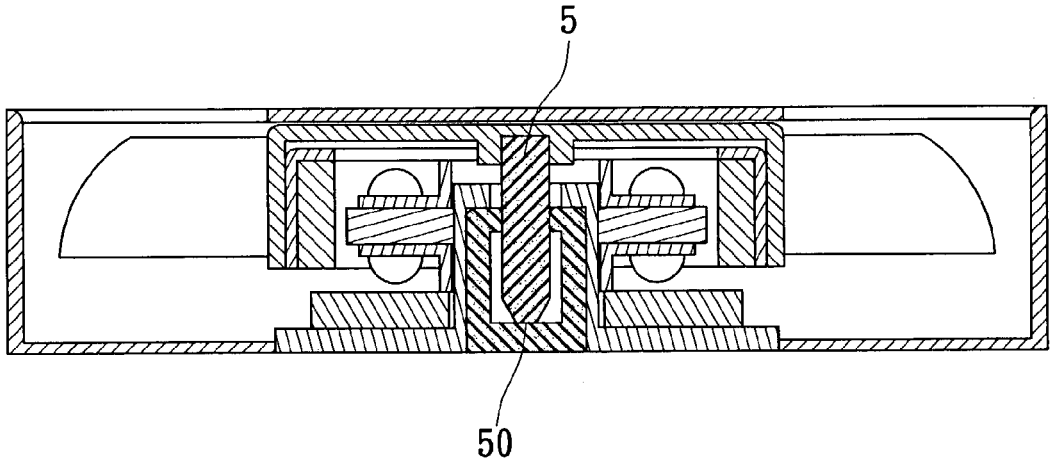
FIG. 7 is a cross-sectional view of a heat-dissipating fan according to a fourth embodiment of the invention.
Figure 8:
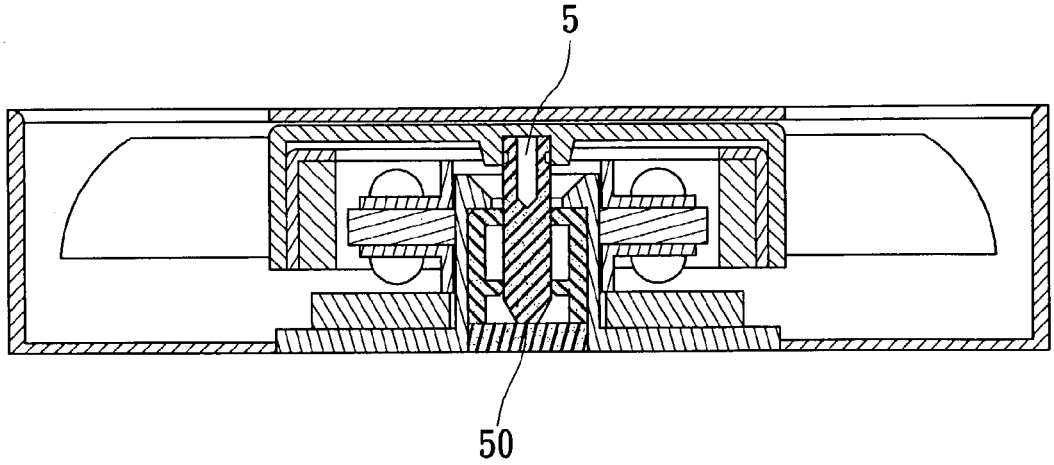
FIG. 8 is cross-sectional view of a heat-dissipating fan according to a fifth embodiment of the invention.

FIG. 7 and FIG. 8 are respectively cross-sectional views of a heat-dissipating fan according fourth and fifth embodiments of the invention. An axle 5 has a tapered tip 50 that is also easily constructed.

The magnetic force center of the silicon steel sheet of the stator is at a level lower than that of the rotor. When an electrical current passes through the silicon steel sheet to generate a magnetic force, the lines of magnetic force induced by the silicon steel sheet and the magnetic bar include a magnetic force component in a radial direction across the axle and a magnetic force component in an axial direction. The radial force component drives the stator in rotation. The axial force component shares the weight load of the rotor to allow the axle to rotate freely in the bearing. Furthermore, with the contact of the axle with the recess through the tapered tip of the axle, the axle is magnetically expelled to levitate. Therefore, the axle is easily positioned in a configuration particularly suitable for use in portable products that may be placed in different positions or orientations. Furthermore, the bearing in a shape of hollow cylinder and having the central hole contacts the axle through the central hole provide advantages such as lower friction, lower noise, low energy consumption, high performance and high stability.

The axle and the bearing are made of a ceramic material that has advantageous properties such as insulation, anti-corrosion, anti-oxidation, anti-erosion and durable service life. The bearing is integrally formed and easily assembled with two components. Any shape of bearing provided with a recess matching with the stator and the base is suitable to prevent a lubricant applied on the axle from leaking out and, further, dust from adhering on the axle and the bearing.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A heat-dissipating fan, comprising:

an axle, having a cylindrical shape and made from a ceramic material;

a bearing having a cylindrical wall, a top side and a bottom side, a disk-shaped base disposed under the bottom side, wherein a central hole is formed through the top side and the bottom side, wherein the axle is engaged in the central hole of the top side and the bottom side and extends down to the disk-shaped base and wherein the diameter of the axle is smaller than the inner diameter of the cylindrical wall forming a space between the axle and the cylindrical wall, and wherein an end of the axle engages the disk-shaped base;

a rotor, including a motor casing, a plurality of blades and a magnetic bar, wherein the motor casing is a casing that has a down-facing opening and a blind hole at a central location of an interior of the motor casing for accommodating the axle, the blades being mounted on an external surface of the motor casing, and the magnetic bar being mounted inside the motor casing; and a stator, including a base, an upper coil frame, a lower coil frame, a coil and a silicon steel sheet, wherein an annular wall extends upward from a central portion of the base for mounting the bearing, the upper coil frame and the lower coil frame being mounted outside the annular wall, the silicon steel sheet being mounted between the upper and lower coil frames, a magnetic force center of the silicon steel sheet being at a level lower than that of the magnetic bar, and the coil being wrapped around the upper coil frame, the silicon steel sheet and the lower coil frame;

wherein the surface of the base where the bearing and the axle contact each other is flat.

2. The heat-dissipating fan of claim 1, wherein the bearing is made of a ceramic material or alloy.

3. The heat-dissipating fan of claim 1, wherein the annular wall has a flange to position securely the bearing in the annular wall.

4. A heat-dissipating fan comprising:

an axle, having a cylindrical shape and made from a ceramic material;

a bearing, having a cylindrical wall, a top side and a bottom side, a disk-shaped base disposed under the bottom side, wherein a central hole is formed the top and the bottom side wherein the axle is engaged in the central hole of the top side and the bottom side and extends down to the disk-shaped base and wherein the diameter of the axle is smaller than the inner diameter of the cylindrical wall forming a space between the axle and the cylindrical wall, and wherein an end of the axle of the axle engages the disk-shaped base;

a rotor, including a motor casing, a plurality of blades and a magnetic bar, wherein the motor casing is a casing that has a down-facing opening and a blind hole at a central location of an interior of the motor casing for accommodating the axle, the blades being mounted on an external surface of the motor casing, and the magnetic bar being mounted inside the motor casing; and a stator, including a base, an upper coil frame, a lower coil frame, a coil and a silicon steel sheet, wherein an annular wall extends upward from a central portion of the base for mounting the bearing, the upper coil frame and the lower coil frame being mounted outside the annular wall, the silicon steel sheet being mounted between the upper and lower coil frames, a magnetic force center of the silicon steel sheet being at a level lower than that of the magnetic bar, and the coil being wrapped around the upper coil frame, the silicon steel sheet and the lower coil frame, wherein a recess is formed at a central location of the surface of the base directly under central hole, and a tip of the axle contacts the recess.

5. The heat-dissipating fan of claim 4, wherein the axle has a rounded tip.

6. The heat-dissipating fan of claim 4, wherein the axle has a pointed tip.

* * * * *